US005745047A

United States Patent [19]

Van Gisbergen et al.

[11] Patent Number: 5,745,047

[45] Date of Patent: Apr. 28, 1998

[54] DOWNHOLE ELECTRICITY TRANSMISSION SYSTEM

[75] Inventors: Stanislaus Johannes Cornelis Henricus Maria Van Gisbergen; Wilhelmus Johannes Godefridus Joseph Der Kinderen, both of Rijswijk, Netherlands

[73] Assignee: Shell Oil Company, Houston, Tex.

[21] Appl. No.: 582,568

[22] Filed: Jan. 3, 1996

[30] Foreign Application Priority Data

Mar. 1, 1995 [EP] European Pat. Off. ..... 95200001.6

[51] Int. Cl.[6] ..... G01V 3/00

[52] U.S. Cl. ..... 340/853.1; 340/854.4; 340/854.9; 340/855.8

[58] Field of Search ..... 340/853.1, 854.4, 340/854.9, 855.8

[56] References Cited

U.S. PATENT DOCUMENTS

| | | | |
|---|---|---|---|
| H1116 | 12/1992 | Love, Jr. | 166/384 |
| 3,072,843 | 1/1963 | Clements et al. | 324/10 |
| 3,435,401 | 3/1969 | Epstein | 338/214 |
| 3,641,658 | 2/1972 | Chevalier et al. | 29/423 |
| 4,001,774 | 1/1977 | Dawson et al. | 340/18 LD |
| 4,057,781 | 11/1977 | Scherbatskoy | 340/18 LD |
| 4,484,627 | 11/1984 | Perkins | 166/248 |
| 4,525,715 | 6/1985 | Smith | 340/854 |
| 4,662,437 | 5/1987 | Renfro | 166/65.1 |
| 4,785,853 | 11/1988 | Okahashi et al. | 138/109 |
| 4,798,769 | 1/1989 | Hayashi et al. | 428/460 |
| 4,839,644 | 6/1989 | Safinya et al. | 340/854 |
| 5,138,313 | 8/1992 | Barrington | 34/854.6 |

FOREIGN PATENT DOCUMENTS

| | | |
|---|---|---|
| 479227 | 3/1916 | France . |
| 2556404 | 6/1985 | France . |
| 2691203 | 11/1993 | France . |
| WO 80/00727 | 4/1980 | WIPO . |
| WO 9113-235-A | 9/1991 | WIPO . |

*Primary Examiner*—J. Woodrow Eldred

[57] ABSTRACT

A downhole electricity transmission system utilizes the wall of an electrically conductive reelable pipe of which the other surface is covered by an electric insulating material to transmit electric signals and/or power to and/or from a downhole location of an underground borehole.

9 Claims, 3 Drawing Sheets

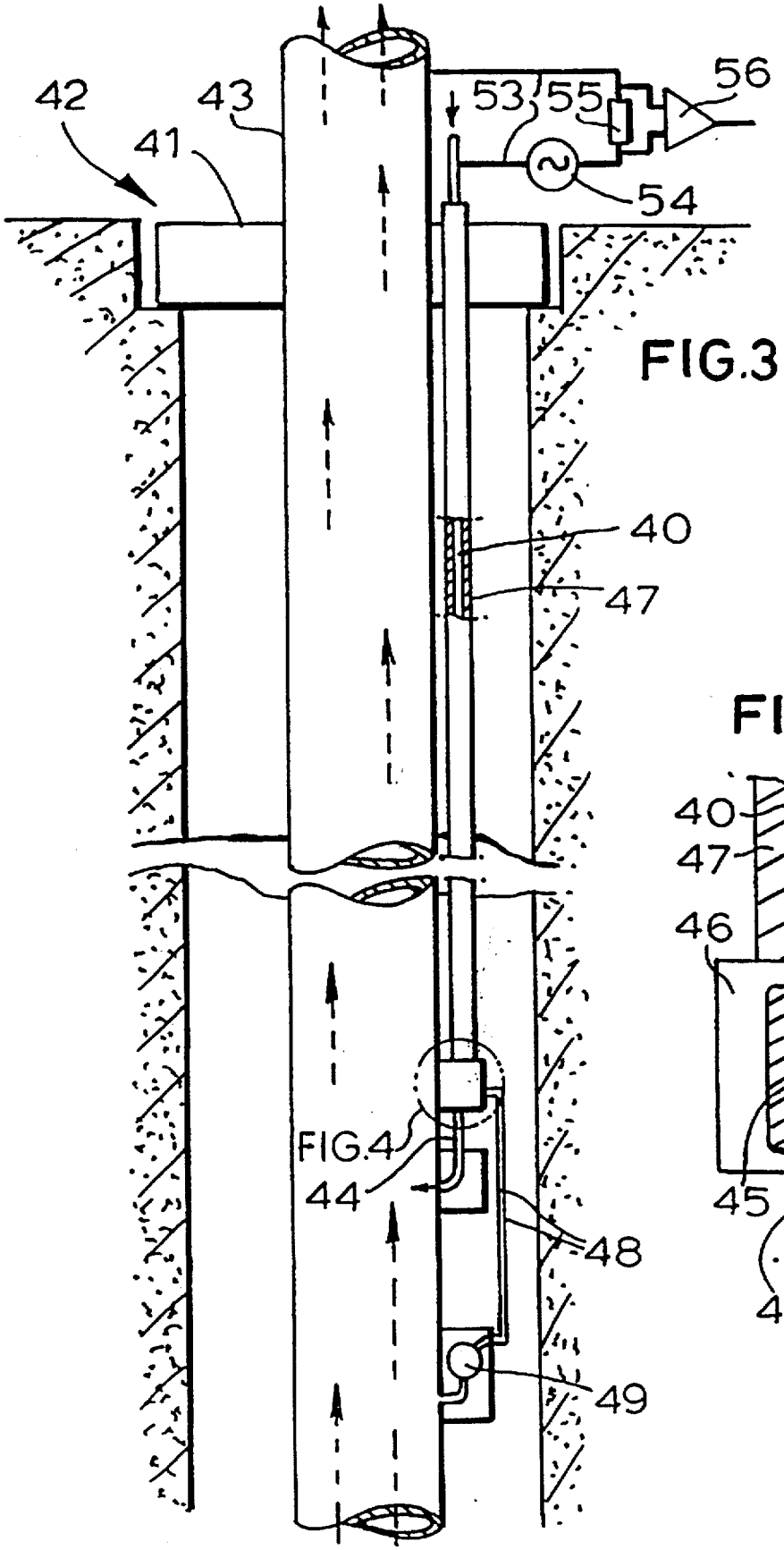
FIG.3
FIG.4
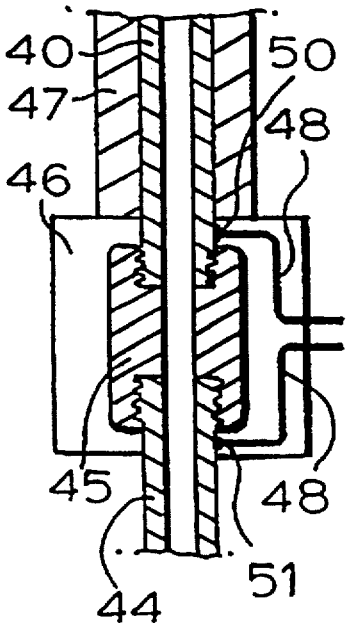

DOWNHOLE ELECTRICITY TRANSMISSION SYSTEM

The invention relates to a downhole electricity transmission system and, more particularly, to a wireless system for transmission of electrical signals and/or power to and/or from a downhole location of a underground borehole for the production of hydrocarbon fluids.

Numerous attempts have been made to create downhole electricity transmission systems which obviate the need for fragile and expensive dedicated electric wiring. A known wireless downhole electricity transmission system is disclosed in U.S. Pat. No. 4,839,644. The system known from this prior art reference comprises an electrical circuit which is formed by an electrically conductive well casing and a well tubing extending therethrough. A toroidal electrical signal transmitter and/or receiver is mounted at a downhole location in the annular space between the casing and tubing, which space is at least partly filled with a substantially non-conductive fluid, such as diesel, crude oil or air.

Another known wireless downhole electricity transmission system is disclosed in U.S. Pat. No. 4,057,781. The system known from this prior art reference consist of a string of drill pipe sections having an insulating coating painted thereon. Toroidal electrical windings are provided at an uphole and a downhole location for transmitting electrical signals via the string of drill pipe sections between the uphole and downhole electrical windings.

The patent states that the drill string sections which are screwed together alternate the electrical signals to such a high degree that the wireless communication is practical over only relatively short distances, for example about 300 meters.

Yet another wireless downhole electricity transmission system is disclosed in International patent application, publication No. WO 80/00727. The system known from this prior art reference utilises a insulated tubing string through which oil or gas is produced for transmission of electrical signals between an uphole and a downhole electrical connector. The known system comprises isolating subs mounted above the upper and below the lower connector for electrically insulating the top and bottom of the tubing string and, to ensure good electrical connection at the joints of the pipe lengths of the tubing string, the pipe lengths may be tightly torqued together such that cold welding occurs at each joint and, in addition, a conducting paste (that may incorporate silver or graphite powder) may be used at each joint.

Obviously the pipe sections of all the above-described prior art systems need to be carefully joined together to ensure that satisfactory electrical connections are made at the pipe joints. In addition measures are required to ensure that the insulation around the pipe string is not interrupted at the pipe joints.

It is an object of the present invention to provide a borehole communication system which does not require the presence of dedicated electrical wires extending through the borehole, which can be installed more easily than the above-described prior art wireless communication systems and in which electrical transmission losses are minimized.

The downhole electricity transmission system according to the invention thereto comprises an electrically conductive pipe which forms part of an electrical system and extends through at least part of the length of an underground borehole, which pipe is at least partly formed by a reelable electrically conductive pipe of which the outer surface is covered over a substantial part of its length by a lining made of an electric insulating material.

Preferably the electrically conductive pipe is a metal pipe.

It is observed that it is known from French patent specification No. 9206341 and U.S. patent specification No. 3,641,658 to use metal reinforcement wires embedded in an intermediate layer of a multilayer flexible composite pipe for the transmission of electricity. Use of such reinforcement wires for electricity transmission requires, however, complex electrical connector systems at the location of the pipe joints.

In a suitable embodiment of the downhole electricity transmission system according to the invention the borehole contains a production tubing for the production of hydrocarbon fluids, which tubing has a smaller outer diameter than the inner diameter of the borehole and the realable pipe is a reelable hydraulic line which is inserted in an annular space between the tubing and the borehole wall, which line is provided with a downhole and an uphole electrical coupling and has an outer surface which is covered over the entire distance between said couplings by a substantially continuous annular body of a plastic electric insulating material.

Preferably the reelable hydraulic line forms part of the group consisting of a reelable hydraulic power supply line and a reelable fluid injection line for injecting a fluid into an underground formation surrounding the borehole.

In an alternative embodiment of the system according to the invention the reelable pipe is a reelable production tubing for the production of hydrocarbon fluids. This tubing is provided with an uphole and a downhole electrical connector comprising a toroidal winding of an electrical conduit. The conduit is surrounded by an electric insulating material and is wound around a ring made of a ferromagnetic material. The ring surrounds a section of the reelable production tubing and the tubing is surrounded over the entire distance between the upper and lower electrical connector by a substantially continuous body of a plastic insulating material.

In yet another embodiment of the system according to the invention the reelable pipe is a reelable drill pipe.

Further features, objects and advantages of the invention will become more readily apparent from the appended claims and from the following detailed description when taken in conjunction with the accompanying drawings, in which FIG. 1 is a schematic representation of a downhole electricity transmission system according to the invention in which a reelable hydraulic power supply line and two toroidal windings are used;

FIG. 3 is a schematic representation of a downhole electricity transmission system according to the invention in which a reelable fluid injection line and two electrical contacts are used; and FIG. 4 shows a longitudinal sectional view of the encircled detail of FIG. 3.

Figure 1:
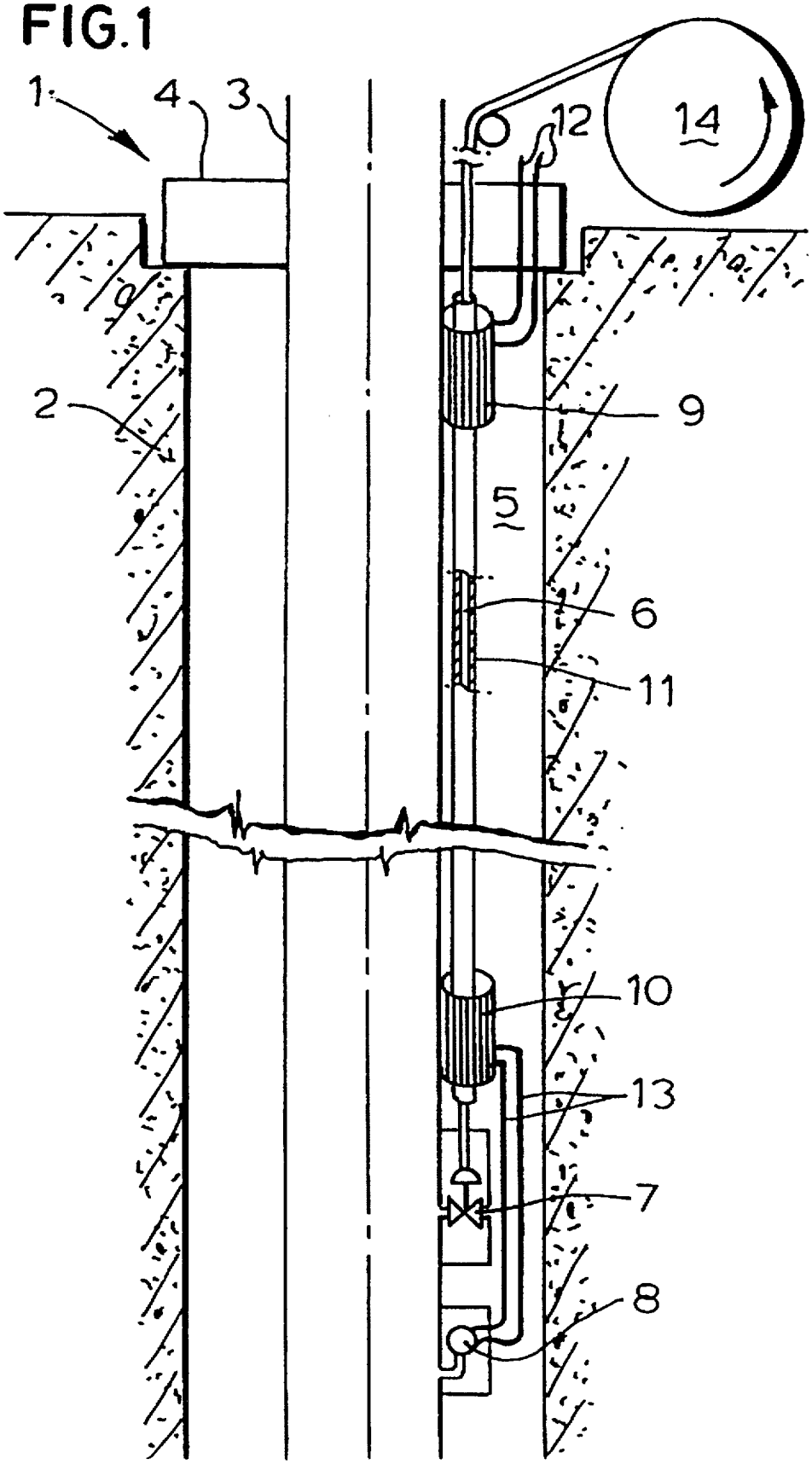

Referring now to FIG. 1, there is shown a borehole in an underground formation 2. A production tubing 3 through which hydrocarbon fluids, such as crude oil and/or natural gas, are produced is suspended within the borehole 1 from a wellhead assembly 4.

The production tubing 3 has a smaller outer diameter than the inner diameter of the borehole 1 and an annular space 5 is formed between the tubing 3 and borehole wall, which space is filled with pressurized gas. A reelable hydraulic power supply line 6 is suspended from the wellhead 4 into the annular space 5. Hydraulic power can be supplied through the line 6 for actuating a downhole valve 7. The valve 7 is a gas-lift valve through which gas may pass from the annular space 5 into the tubing 3 to provide a gas-lift for stimulating the production of crude oil through the well.

A downhole monitoring device 8 is mounted below the valve 7 to monitor the downhole pressure, temperature, velocity and/or composition of the fluids flowing through the tubing 3.

A bi-directional electrical transmission system is provided for supplying electric energy to the device 8 and for transmitting electric signals that represent the monitored data from the device 8 to the surface.

The transmission system utilizes the electrically conductive metal wall of the hydraulic line 6 to transmit electrical signals and power via an uphole toroidal coupling 9 and a downhole toroidal coupling 10 to and/or from the monitoring device 8.

Each toroidal coupling 9, 10 comprises a toroidal winding of an electrical conduit which is covered by an electric insulating material (not shown) and which is wound around a ring (not shown) of a ferromagnetic material that surrounds a section of the hydraulic line 6. The outer surface of the hydraulic line 6 is over the entire distance between the connections 9 and 10 covered by an annular lining of a plastic insulating material.

The hydraulic line 6 is electrically connected to the metal tubing 3 via the wellhead 4 and the downhole valve 7 such that the hydraulic line 6 and tubing 3 form a closed electrical circuit.

The two ends 12 of the electrical conduit of the uphole coupling 9 pass through the wellhead 4 to an electrical power source and data processor (not shown), whereas the two ends 13 of the electrical conduit of the downhole coupling 10 are connected to the device 8.

If the electrical power source generates an electrical current between the ends 12 of the electrical conduit of the uphole coupling 9 a magnetic field is induced in the ferromagnetic ring of the coupling 9, which field induces an electrical current to flow through the electrical circuit formed by the hydraulic line 6, tubing 3, wellhead 4 and downhole valve 7.

Likewise, the electrical current flowing through said circuit induces a magnetic field in the ferromagnetic ring of the downhole coupling 10, which field induces an electrical current to flow between the ends 13 of the electrical conduit of that coupling 10.

In the above-described manner electrical energy is transmitted from the electrical energy source at the surface to the downhole monitoring device 8, without the need for dedicated electrical wiring.

A reelable hydraulic power supply line 6 which is installed in the annulus 5 by winding the line 6 from a drum 14 at the wellhead (which drum 14 is normally removed after installation of the line 6) is particularly suitable for use as electricity transmitter in the system according to the invention since such a line can be made in large lengths. Such a line can be provided with a continuous layer of insulation which makes installation easy and which creates an efficient electrical transmission link in which interference is minimized.

Electrical signals can be transmitted from the downhole device 8 to the uphole data processor (not shown) at the surface via the electrical system in the same way as described above with reference to the transmission of electrical energy from the uphole power source to the device 8.

Figure 2:
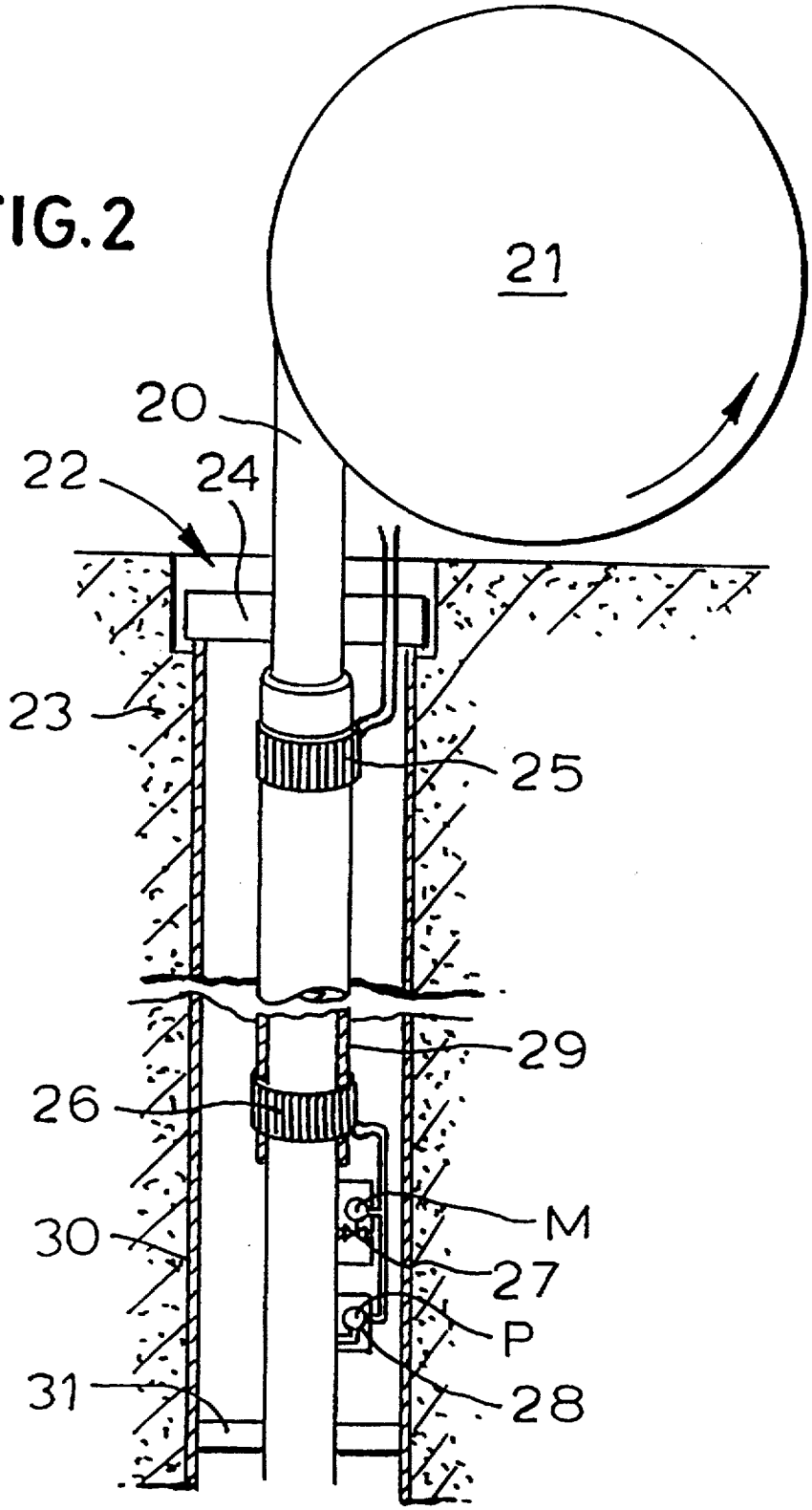
FIG. 2 is a schematic representation of a downhole electricity transmission system according to the invention in which a reelable production tubing and two toroidal windings are used.

FIG. 2 shows an alternative embodiment of the electrical transmission system according to the invention in which the reelable pipe is formed by a coiled production tubing 20 which has been reeled from a drum 21 into a borehole 22 that has been drilled into a subterranean earth formation 23.

After installation the tubing 20 is suspended from a wellhead 24 and the drum 21 is removed.

An electrical transmission system is provided by the metal wall of the tubing and two toroidal couplings 25 and 26. The system provides electrical energy for actuating a downhole valve 27 and data monitoring device 28 and for transmitting data obtained by the device 28 to the surface.

The outer surface of the reelable tubing 20 is over the entire distance between the couplings 25 and 26 covered by a lining of a plastic insulating material 29. The tubing 20 forms together with a steel well casing 30 and a steel downhole packer 31 and the wellhead 24 an electrical circuit through which electrical energy and/or signals are transmitted in the manner as described with reference to the circuit of FIG. 1.

FIG. 3 shows yet another embodiment of the electrical transmission system according to the invention where an insulated reelable fluid injection line 40 is used for the transmission of electrical signals and/or power.

The injection line 40 is suspended from a wellhead 41 into a borehole 42 adjacent to a conventional steel production tubing 43.

The injection line 40 is, as shown in FIG. 4, at its lower end connected to an injection nozzle 44 via an electrically insulating sub 45 which is embedded in a body 46 of insulating material. The outer surface of the line 40 is covered by an annular body 47 of a plastic insulating material which extends from above the wellhead 41 until the upper end of the body 46.

The steel nozzle 44 is electrically connected to the production tubing 43 and a pair of electrical wires 48 interconnect a downhole data monitoring device 49 with electrical contacts 50 and 51 on the injection line 40 and the nozzle 44, respectively.

At the surface electrical wirings 53 interconnect the tubing 43 and the injection line 40, which wirings 43 are equipped with an electrical power source 54, an impedance 55 and an electric amplifier 56.

In the embodiment shown in FIGS. 3 and 4 an electrical circuit is formed by the walls of the hydraulic line 40 and of the production tubing 43 and of the nozzle 44, the downhole wires 48 and the wiring 53 at the surface.

The power source 54 generates an alternating electric current in the circuit for supplying electrical power to the downhole monitoring device 49. Any electric signals generated by the downhole monitoring device 49 are transmitted upwardly through the circuit and generate an electric signal across the impedance 55 which is amplified by the amplifier 56 and then transmitted to a data processor (not shown).

In an alternative embodiment of the well shown in FIG. 3 a casing string (not shown) may surround the production tubing 43. This casing string may be fixed within the borehole 42 by a substantially annular body of cement that fills the annular gap between the casing string and borehole wall. If, in that case, the production tubing 43 needs to be regularly replaced, the insulated reelable injection line 40 may be installed in the annular body of cement.

In that case the reelable injection line would pass through a downhole opening in the wall of the casing into the interior of the casing and be connected to the nozzle 44 by a stab-in pipe connector. This connector could be equipped with electrical contacts or a co-annular inductive electrical coupling to interconnect one of the wires 48 of the downhole monitoring device 49 and the metal wall of the reelable injection line.

In many oil and/or gas production wells there are one or more production tubings which are fixed within the well casing by a series of steel packers and the annular space between the casing and tubing(s) is filled with an electrically conductive brine. If in that situation an insulated fluid injection line as depicted in FIG. 3 is used as one half of the electrical circuit then the other half of the circuit would be formed by the assembly of tubing(s), casing(s) and brine, which assembly will provide an efficient electric link.

It will be understood by those skilled in the art of petroleum engineering that the use of an at least partly insulated reelable pipe for transmission of electricity through an underground borehole in accordance with the present invention will provide a reliable and efficient electric link which can be easily installed in the borehole.

It will also be understood that the reelable pipe may also consist of a coiled drill pipe which is run into a well which is being drilled from a drum.

We claim:

1. A downhole electricity transmission apparatus comprising:

an electrically conductive pipe that extends through at least a portion of a length of an underground borehole wherein the electrically conductive pipe is reelable;

an insulating lining around the outer surface of the electrically conductive pipe;

a production tubing in the borehole for production of hydrocarbon fluids, wherein the production tubing has a smaller outer diameter than the inner diameter of the borehole and the reelable pipe is a reelable hydraulic line which is inserted in an annular space between the tubing and the borehole, and the hydraulic line is provided with a downhole and an uphole electrical coupling and has an outer surface which is covered over the entire distance between the couplings by a substantially continuous annular body of a plastic electric insulating material; and a well casing in the annular space between the production tubing and the borehole wall, which well casing is fixed to the borehole wall by means of a substantially annular body of cement and the reelable hydraulic line extends at least partly through the annular body of cement.

2. The apparatus of claim 1 wherein the electrically conductive pipe is a metal pipe.

3. The apparatus of claim 1 wherein at least one of the electrical couplings comprises a toroidal winding of an electrical conduit which is surrounded by an electric insulating material and which is wound around a ring made of a ferromagnetic material, which ring surrounds a section of the reelable hydraulic line.

4. The apparatus of claim 3 wherein the reelable hydraulic line forms, together with another conductive well tubular, an electrical system in the form of a circuit, which is closed by providing electric connections between the wall of the hydraulic line and the other well tubular above the uphole and below the downhole electrical coupling.

5. The apparatus of claim 4 wherein the other well tubular forms part of the group consisting of an electrically conductive well casing, an electrically conductive production tubing for production of hydrocarbon fluids, and an annular space formed between a well casing and production tubing, which space is filled with an electrically conductive liquid.

6. The apparatus of claim 5 wherein the electrically conductive liquid is brine.

7. The apparatus of claim 1 wherein the reelable hydraulic line is selected from the group comprising a reelable hydraulic power supply line and a reelable fluid injection line for injecting a fluid into an underground formation surrounding the borehole.

8. The apparatus of claim 1 wherein the reelable pipe is a reelable production tubing for production of hydrocarbon fluids, which tubing is provided with an uphole and a downhole electrical connector comprising a toroidal winding of an electrical conduit which is wound around a ring made of a ferromagnetic material, which ring surrounds a section of the reelable production tubing and the tubing is surrounded over the entire distance between the upper and lower electrical connector by a substantially continuous body of a plastic insulating material.

9. A downhole electricity transmission apparatus comprising:

an electrically conductive pipe that extends through at least a portion of a length of an underground borehole wherein the electrically conductive pipe is a reelable drill pipe; and an insulating lining around the outer surface of the electrically conductive pipe.

* * * * *